US005333463A

United States Patent [19]

Garnier et al.

[11] Patent Number: 5,333,463

[45] Date of Patent: Aug. 2, 1994

[54] PRODUCTION AND INSTALLATION FOR THE PRODUCTION OF GASEOUS NITROGEN AT SEVERAL DIFFERENT PURITIES

[75] Inventors: Catherine Garnier, Paris, France; Francois Venet, Walnut Creek, Calif.

[73] Assignee: L'Air Liquide, Societe Anonyme Pour L'Etude et L'Exploitation Des Procedes Georges Claude, Paris, France

[21] Appl. No.: 81,813

[22] Filed: Jun. 22, 1993

[51] Int. Cl.[5] ..... F25J 3/00; F25J 3/02

[52] U.S. Cl. ..... 62/24; 62/18; 62/21; 62/33; 62/37; 62/40; 62/44

[58] Field of Search ..... 62/18, 21, 24, 33, 37, 62/40, 44

[56] References Cited

U.S. PATENT DOCUMENTS

| | | | |
|---|---|---|---|
| 3,735,599 | 5/1973 | Izumichi et al. | 62/37 X |
| 4,529,425 | 7/1985 | McNeil | 62/37 |
| 4,566,887 | 1/1986 | Openshaw | 62/37 X |
| 4,595,405 | 6/1986 | Agrawal | 62/18 |
| 4,617,040 | 10/1986 | Yoshino | 62/44 X |
| 4,668,260 | 5/1987 | Yoshino | 62/33 X |
| 4,783,210 | 11/1988 | Ayers et al. | 62/24 |
| 4,834,785 | 5/1989 | Ayers | 62/33 X |
| 4,853,015 | 8/1989 | Yoshino | 62/40 |
| 4,902,321 | 2/1990 | Cheung | 62/24 |
| 5,058,387 | 10/1991 | Kamrath | 62/40 X |
| 5,084,081 | 1/1992 | Rohde | 62/24 X |
| 5,157,927 | 10/1992 | Darchis et al. | 62/37 |
| 5,165,244 | 11/1992 | Kleinberg et al. | 62/24 |
| 5,170,630 | 12/1992 | Stern | 62/24 |
| 5,205,127 | 4/1993 | Agrawal | 62/24 |
| 5,209,070 | 5/1993 | Darredeau | 62/37 X |
| 5,218,825 | 6/1993 | Agrawal | 62/24 X |
| 5,224,336 | 7/1993 | Agrawal et al. | 62/37 |
| 5,289,688 | 3/1994 | Agrawal | 62/33 X |

FOREIGN PATENT DOCUMENTS

| | | | |
|---|---|---|---|
| 0299364 | 1/1989 | European Pat. Off. . | |
| 0407136 | 1/1991 | European Pat. Off. . | |
| 2051476 | 4/1971 | Fed. Rep. of Germany . | |
| 3732363 | 4/1989 | Fed. Rep. of Germany | 62/37 |
| 2170894 | 8/1986 | United Kingdom . | |

*Primary Examiner*—Henry A. Bennet
*Assistant Examiner*—Christopher Kilner
*Attorney, Agent, or Firm*—Curtis, Morris & Safford

[57] ABSTRACT

A column for production of nitrogen by the distillation of air, adapted to produce high purity nitrogen at its head, is associated with an external source of medium purity liquid nitrogen that is fitted with a device for the liquid phase adsorption of carbon monoxide, and with a reservoir for the storage of high purity liquid nitrogen. The column produces medium purity gaseous nitrogen and high purity gaseous nitrogen by direct withdrawals, optionally supplemented by vaporization of liquid nitrogen.

11 Claims, 1 Drawing Sheet

PRODUCTION AND INSTALLATION FOR THE PRODUCTION OF GASEOUS NITROGEN AT SEVERAL DIFFERENT PURITIES

BACKGROUND OF THE INVENTION

The present invention relates to a process for the production of gaseous nitrogen having several different purities, where medium purity is typically of the order of 1 ppm and at least one high purity, typically of the order of 1 ppb or 100 ppb, with a variable demand for these products.

Certain industries, such as the electronics industry, have needs which vary over time for gaseous nitrogen of several different purities, where a medium purity is typically 1 ppm and at least one high purity, typically 1 ppb, these purities being considered relative to the principal impurity, oxygen.

OBJECTS AND SUMMARY OF THE INVENTION

The object of the invention is to provide a response to this demand.

For this purpose, the aim of the invention is a process for the production of gaseous nitrogen having several different purities, where a medium purity is typically of the order of 1 ppm and at least one high purity, typically of the order of 1 ppb or 100 ppb, with a variable demand for these products, characterized by the fact that:

air previously purified to be free of water, carbon dioxide, carbon monoxide and hydrogen is distilled in a column for the production of nitrogen by distillation of air having a sufficient number of theoretical plates so as to obtain high purity nitrogen at the head of the column;

a stream of medium purity gaseous nitrogen is withdrawn from production at an intermediate level of the column;

high purity gaseous nitrogen is withdrawn at at least one level of the column higher than the said intermediate level; and during at least a part of the periods when the demand for high purity nitrogen is below a predetermined value, there is injected into the column, essentially at the said intermediate level, liquid nitrogen having a medium purity, free of carbon monoxide, derived from a source external to the column, and an equivalent stream of high purity liquid nitrogen withdrawn at the said higher level of the column is sent to a storage reservoir.

In accordance with other characteristics, a supplementary stream of medium purity liquid nitrogen coming from the external source and/or a supplementary stream of high purity liquid nitrogen coming from the storage reservoir is vaporized;

the installation is kept cold solely by the injection into the column of medium purity liquid nitrogen coming from the external source;

the medium purity liquid nitrogen to be injected into the column is freed of carbon monoxide by liquid phase adsorption, in particular on a zeolite;

the flow of treated air is caused to vary about its nominal value.

The object of the invention is likewise an installation intended to carry out such a process. This installation is characterized by the fact that it comprises:

a column for the production of nitrogen by distillation of air, having a sufficient number of theoretical plates so as to obtain high purity nitrogen at the head of the column;

a source of medium purity liquid nitrogen free of carbon monoxide, external to the column, connected to an intermediate level of this column;

a pipe for withdrawing medium purity gaseous nitrogen from production which leaves essentially from the same intermediate level of the column;

a pipe for withdrawing high purity gaseous nitrogen from production, leaving from a level of the column higher than the said intermediate level; and a reservoir for the storage of high purity liquid nitrogen, connected to the said higher level of the column.

BRIEF DESCRIPTION OF THE DRAWINGS

An example of the operation of the invention will now be described with reference to the accompanying drawings, in which.

DETAILED DESCRIPTION

Figure 1:
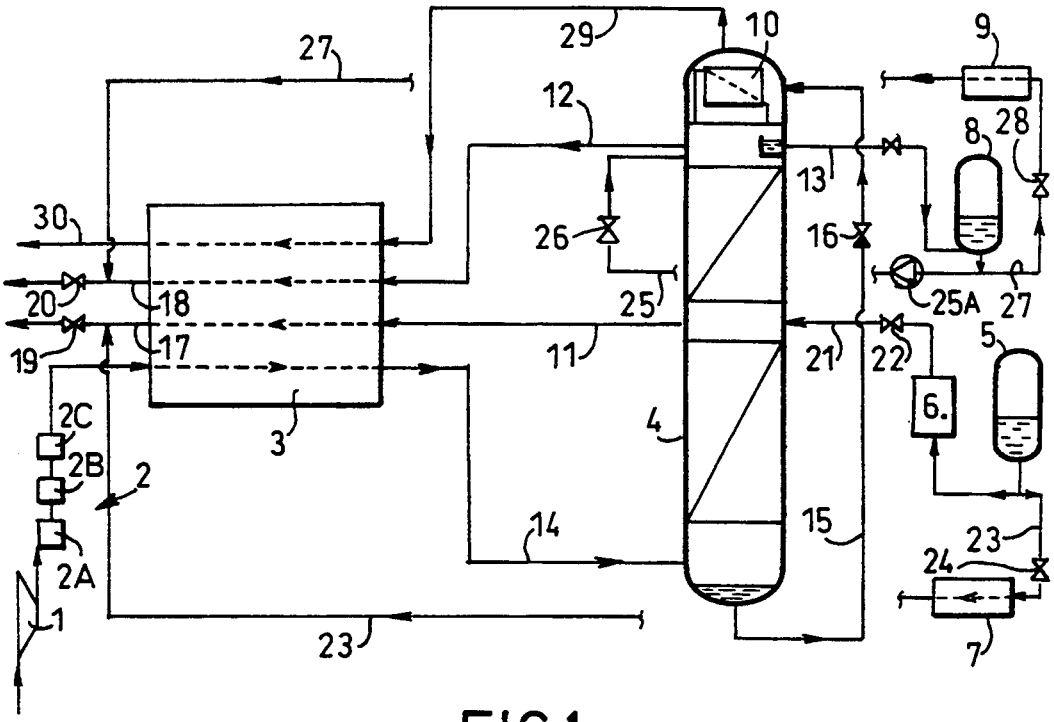
FIG. 1 represents schematically an installation for the production of nitrogen in accordance with the invention.

The installation represented on FIG. 1 comprises essentially a compressor 1 for entering air, a purification apparatus 2 for the air leaving this compressor, a heat exchanger 3, a column 4 for the production of nitrogen by distillation of air, a reservoir 5 for the storage of "commercial" liquid nitrogen having a purity of the order of 1 ppm, a carbon monoxide adsorber 6, and a vaporizer-reheater 7, for example atmospheric, associated with this reservoir. The installation further includes a reservoir 8 for the storage of high purity liquid nitrogen, and a vaporizer-reheater 9, for example atmospheric, associated with reservoir 8.

This installation is intended to produce two gas flows of gaseous nitrogen, one having the medium purity on the order of about 1 ppm and the other having a high purity, typically on the order of about 1 ppb to about 100 ppb.

The purification apparatus 2 is adapted, on the one hand, to eliminate from the entering air a portion of the impurities which interfere with its refrigeration, namely water and carbon dioxide ($CO_2$), and on the other hand the impurities whose separation from nitrogen cannot be achieved by distillation, notably carbon monoxide (CO) and hydrogen. For this, apparatus 2 comprises: at the exit of compressor 1, a catalyst pot 2A permitting the reactions $2CO+O_2 \rightarrow 2CO_2$ and $2H_2+O_2 \rightarrow 2H_2O$ to occur at the temperature of the compressor exit (in accordance with Japanese Patent JP-A-61-225568); then a chiller 2B adapted to bring the compressed air close to ambient temperature; then an adsorber 2C which provides for the elimination of water and $CO_2$.

Heat exchanger 3 is adapted to place a portion of the purified entering air, on the one hand, in an indirect, counter-current heat exchange relationship with the cold products coming from column 4.

Distillation column 4 has a number of theoretical plates to furnish nitrogen of the desired high purity at the head of the column. It carries a condenser head 10 and can produce medium purity gaseous nitrogen via a take-off pipe 11, high purity gaseous nitrogen via a pipe 12, and high purity liquid nitrogen via a pipe 13. Pipe 11 leaves the column at an intermediate point, whereas pipes 12 and 13 leave from its head. The column is fed, via a pipe 14, with entering air, cooled to the neighborhood of its dew point. The "rich liquid" (air enriched with oxygen) collected in the tank is sent to the condenser head 10, via a pipe 15 fitted with an expansion valve 16. At the hot end of exchanger 3, pipes 11 and 12 are extended to production pipes 17 and 18, for the production of medium purity nitrogen and for the production of high purity nitrogen, respectively. These pipes 17 and 18 are provided with valves 19 and 20, respectively.

The bottom of reservoir 5 is connected via a pipe 21, provided with a valve 22 and passing through adsorbent 6, to a point for the injection of medium purity liquid nitrogen into the column, located at the same level as take-off pipe 11. It is also connected, by means of a pipe 23, which is provided with valve 24 and passes through vaporizer 7, to production pipe 17.

The bottom of reservoir 8 is connected, via a pipe 25 provided with a pump 25A and a valve 26, to the head of the column, and via a pipe 27, provided with a valve 28 and passing through vaporizer 9, to production pipe 18.

A pipe 29 for residual gas (vaporized rich liquid) leaves condenser 10 and, at the hot end of the exchanger, it extends to a pipe 30 for evacuating residual gas.

In operation, supposing first of all that reservoir 8 is full, the column furnishes only two streams of gaseous nitrogen, via pipes 11 and 12. The sum of the flows of the two streams is constant and equal to the total production capacity of gaseous nitrogen of column 4. The output of treated air is supposed to be essentially constant and equal to the nominal output of the installation.

The maintenance of low temperatures in the installation is achieved solely by injection of medium purity liquid nitrogen through pipe 21 ("feeding"). In adsorber 6, which contains an appropriate zeolite, this liquid nitrogen is freed of CO to a purification level sufficient to attain the purity required of high purity nitrogen.

Figure 2:
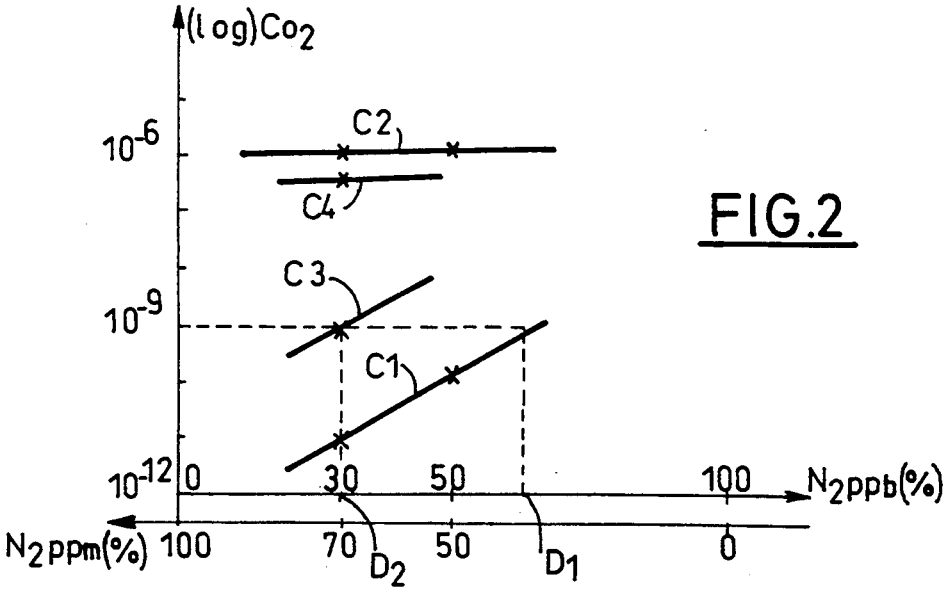
FIG. 2 is a graphical diagram relating to the operation of the said installation, with the rates of flow of gaseous nitrogen withdrawn from the column being plotted as the abscissa, and the logarithm of the oxygen concentration of the two streams of gaseous nitrogen is plotted as the ordinate.

For an increasing percentage of output of high purity nitrogen withdrawn from the column, relative to the total output of gaseous nitrogen withdrawn, FIG. 2 shows (curve C1) that the purity deteriorates progressively and reaches a value of the order of 1 ppb for a maximum output rate D1 of the order of 60 to 70%. On the other hand, the oxygen content of the medium purity nitrogen (curve C2) remains practically constant, regardless of the distribution of the two streams of nitrogen.

If the demand for high purity nitrogen is greater than this maximum output rate, the supplementary amount is furnished by direct vaporization of high purity liquid nitrogen via pipe 27 and vaporizer 9.

The same type of operation can be maintained as long as liquid remains in reservoir 8.

When reservoir 8 is empty, the production of high purity nitrogen is limited to the withdrawal of gas via pipe 12 and cannot exceed the maximum output D1 cited above. Moreover, to fill reservoir 8, a particular flow of high purity liquid nitrogen is withdrawn from column 4 via pipe 13 and an equivalent quantity of medium purity liquid nitrogen, free of CO, is introduced via pipe 21.

In that case, as shown in FIG. 2, and supposing a flow of high purity liquid nitrogen withdrawn equal to 40% of the gaseous nitrogen production capacity of the column, the purity of the high purity gaseous nitrogen withdrawn (curve C3) deteriorates more rapidly than indicated above, and reaches a value of the order of 1 ppb for an output of high purity gaseous nitrogen D2 of the order of 30% of the total output of gaseous nitrogen withdrawn. The purity of the medium purity gaseous nitrogen (curve C4), as above, is practically constant, and slightly greater than that which it was in the absence of withdrawal of high purity liquid nitrogen.

Thus, starting from a situation where the reservoir is empty:

the installation furnishes a continuous stream of high purity gaseous nitrogen up to an output of the order of 60 to 70% of the total flow of gaseous nitrogen withdrawn;

when the demand for high purity nitrogen is less than about 30%, the reserve of high purity liquid nitrogen in reservoir 8 can be reconstituted with a flow of liquid nitrogen equal to 40% of the column's capacity for the production of gaseous nitrogen.

If the demand for high purity nitrogen is between 30 and 60%, high purity liquid nitrogen can still be sent to reservoir 8, but with a lower flow rate than the above-stated 40%.

Of course, the reconstitution of the reserve of high purity liquid nitrogen can likewise be accomplished when reservoir 8 is partially filled, under the same conditions of demand for high purity nitrogen.

It should be noted that if reservoir 5 is accidentally empty, the installation can continue to operate by using, as the "feeding" liquid, high purity liquid nitrogen introduced into the head of the column via pipe 25.

It is understood that the installation can easily be modified to produce nitrogen at more than two different purities. Thus, if it is desired to produce nitrogen at an intermediate purity of 100 ppb as well, column 4 can be connected to a reservoir for supplementary liquid nitrogen, the connection being made at a level of the column between pipes 13 and 21, and associated with a vaporizer analogous to vaporizer 9, and further with a supplementary pipe installed at the same level of the column for withdrawing 100 ppb gaseous nitrogen.

Moreover, in certain applications, an additional flexibility of the installation can be achieved by varying the flow of treated air about the nominal value.

What is claimed is:

1. A process for the production of gaseous nitrogen having different gas flows exhibiting respectively different purities, including a medium purity on the order of 1 ppm and at least one high purity on the order of 1 ppb to 100 ppb, with a variable demand for said gas flows, comprising the steps of:

distilling in a column having a sufficient number of theoretical plates so as to obtain high purity nitrogen at a head of the column air that is purified to be free of water, carbon dioxide, carbon monoxide and hydrogen;

withdrawing from production at an intermediate level of the column a stream of gaseous nitrogen whose purity is of medium production purity;

withdrawing from at least one level of the column higher than the said intermediate level gaseous nitrogen of high purity; and injecting into the column substantially at said intermediate level during at least a part of those periods when the demand for high purity nitrogen is below a predetermined value, liquid nitrogen having a medium purity, free of carbon monoxide and derived from a source external to the column, withdrawing at said higher level of the column an equivalent stream of high purity liquid nitrogen and sending the withdrawn stream of high purity liquid nitrogen to a storage reservoir.

2. A process in accordance with claim 1 further comprising the step of vaporizing the liquid nitrogen having medium purity flowing from said external source.

3. A process in accordance with claim 1 further comprising the step of supplying a vaporized supplementary stream of high purity liquid nitrogen from said storage reservoir.

4. A process in accordance with claim 1 further comprising the step of maintaining said column at relatively low temperatures solely by injecting into said column the liquid nitrogen of medium purity from said external source.

5. A process in accordance with claim 1 further comprising the step of freeing the liquid nitrogen of medium purity of carbon monoxide by liquid phase adsorption on a zeolite prior to injection from said external source into said column.

6. A process in accordance with claim 1 further comprising the step of causing said air to flow at a value that varies about its nominal value.

7. An installation for the production of gaseous nitrogen having different gas flows exhibiting respectively different purities, including a medium purity on the order of 1 ppm and at least one high purity on the order of 1 ppb to 100 ppb, with a variable demand for said gas flows, comprising:

a column to produce nitrogen by air distillation, said column having a head and having a sufficient number of theoretical plates so as to obtain high purity nitrogen at said head;

a source of medium purity liquid nitrogen free of carbon monoxide, external to the column, said source being connected to an intermediate level of said column;

a first pipe coupled to the intermediate level of the column for withdrawing medium purity gaseous nitrogen from production;

a second pipe coupled to a level of said column higher than said intermediate level for withdrawing high purity gaseous nitrogen from production; and a reservoir connected at said higher level of the column for the storage of high purity liquid nitrogen.

8. An installation in accordance with claim 7, further comprising means for vaporizing the liquid nitrogen of medium purity flowing from said external source.

9. An installation in accordance with claim 7 further comprising means for vaporizing the liquid nitrogen of high purity flowing from said reservoir.

10. An installation in accordance with claim 7 wherein said external source includes an adsorber for carbon monoxide in the liquid phase, said adsorber containing a zeolite.

11. An installation in accordance with claim 7 wherein said external source is a storage reservoir for liquid nitrogen of medium purity.

* * * * *

UNITED STATES PATENT AND TRADEMARK OFFICE

CERTIFICATE OF CORRECTION

PATENT NO. : 5,333,463

DATED : August 2, 1994

INVENTOR(S) : Catherine Garnier and Francois Venet

It is certified that error appears in the above-identified patent and that said Letters Patent is hereby corrected as shown below:

On the title page, insert the following:

--Foreign Application Priority Data

July 29, 1992 [FR] France.....9209347--

Signed and Sealed this

Fourth Day of October, 1994

*Attest:*

*Attesting Officer*

Bruce Lehman

BRUCE LEHMAN

*Commissioner of Patents and Trademarks*